US005530466A

United States Patent [19]

Fujioka et al.

[11] Patent Number: 5,530,466

[45] Date of Patent: Jun. 25, 1996

[54] INK JET PRINTER

[75] Inventors: Satoshi Fujioka; Hiromu Hirabayashi; Nobuhisa Takayashi; Atsushi Nishizawa; Kiyoto Komuro, all of Nagano, Japan

[73] Assignee: Seiko Epson Corporation, Tokyo, Japan

[21] Appl. No.: 308,936

[22] Filed: Sep. 20, 1994

Related U.S. Application Data

[62] Division of Ser. No. 908,737, Jul. 6, 1992, Pat. No. 5,373,312, which is a continuation of Ser. No. 599,577, Oct. 18, 1990, abandoned.

[30] Foreign Application Priority Data

| | | | |
|---|---|---|---|
| Oct. 19, 1989 | [JP] | Japan | 1-273273 |
| Dec. 1, 1989 | [JP] | Japan | 1-313175 |
| Jun. 5, 1990 | [JP] | Japan | 2-146771 |
| Sep. 4, 1990 | [JP] | Japan | 2-233807 |

[51] Int. Cl.[6] ..... B41J 2/01; B41J 13/076

[52] U.S. Cl. ..... 347/104; 226/193; 400/641; 492/27

[58] Field of Search ..... 347/104; 346/134, 346/136; 400/641; 492/30, 33, 34, 27; 226/193

[56] References Cited

U.S. PATENT DOCUMENTS

| | | | |
|---|---|---|---|
| 4,115,817 | 9/1978 | Suzuki et al. . | |
| 4,212,555 | 7/1980 | Rosenstock . | |
| 4,340,893 | 7/1982 | Ort . | |
| 4,469,026 | 9/1984 | Irwin . | |
| 4,496,257 | 1/1985 | Habelt | 400/578 |
| 4,527,174 | 7/1985 | Fujiwara et al. . | |
| 4,566,014 | 1/1986 | Paranjpe et al. . | |
| 4,755,877 | 7/1988 | Vollert | 358/285 |
| 4,787,764 | 11/1988 | Ikeda et al. . | |
| 5,005,025 | 4/1991 | Miyakawa | 347/102 X |
| 5,023,728 | 6/1991 | Nimura et al. . | |

FOREIGN PATENT DOCUMENTS

| | | | |
|---|---|---|---|
| 3708601 | 10/1987 | Germany | B41J 13/03 |
| 40122982 | 9/1989 | Japan | B41J 13/10 |

OTHER PUBLICATIONS

Patent Abstracts of Japan, vol. 12, No. 18 (M–660) [2865], Jan. 20, 1988 & JP–A–62 178 370 (Y. Sasaki) May 8, 1987.

Patent Abstracts of Japan, vol. 11, No. 281 (M–264) [2728], Sep. 11, 1987 & JP–A–62 080 074 (H. Inoue) Apr. 13, 1987.

Research Disclosure, No. 185, Sep. 1979, pp. 472–473.

Ayash et al., "Ink Jet Dryer With Individually Actuable Elements"; Xerox Disclosure Journal vol. 7, No. 5, Sep./Oct. 1982, pp. 317–318.

*Primary Examiner*—Joseph W. Hartary

*Attorney, Agent, or Firm*—Sughrue, Mion, Zinn, Macpeak & Seas

[57] ABSTRACT

In an ink jet printer having a sheet conveying mechanism which changes the speed of conveyance of a recording sheet in accordance with the density of characters or a pattern to be printed to intermittently convey the recording sheet in such a manner that all printed portions are properly dried before the sheet is conveyed to a subsequent position. The recording head of the printer performs a printing operation while pushing the front end portion of the recording sheet against the platen with a sheet retaining lever.

5 Claims, 8 Drawing Sheets

| INK COMSUMPTION QUANTITY (g) | INK DRYING TIME PERIODS (s) |
|---|---|
| 0 | 0 |
| 5 | 2 |
| 10 | 4 |
| 15 | 6 |
| 20 | 8 |
| 25 | 10 |
| 30 | 12 |
| 35 | 14 |

| ROW | INK DRYING TIME PERIODS (Dx) | ESTIMATED INK DRYING COMPLETION TIME INSTANTS (Tx) |
|---|---|---|
| 1 | 4 | 86 |
| 2 | 2 | 88 |
| 3 | 4 | 92 |
| 4 | 6 | 98 |
| 5 | 2 | 100 |
| 6 | 2 | 102 |
| 7 | 2 | 104 |
| | | |

INK JET PRINTER

This is a divisional of application Ser. No. 07/908,737 filed Jul. 6, 1992, now U.S. Pat. No. 5,373,312, which is a continuation of application Ser. No. 07/599,577 filed Oct. 18, 1990, now abandoned.

BACKGROUND OF THE INVENTION

The present invention relates to an ink jet printer in which ink is jetted selectively from a number of nozzles.

An ink jet printer for jetting ink from a selected one or plural nozzles to record characters, patterns, etc., on a recording sheet is advantageous in that it makes no noise while in operation and it can record data on an ordinary recording sheet at low operating cost.

In general, an ink jet printer of this type uses water-soluble ink in order to stabilize the writing operation. As a result, the printer may suffer from the difficulty that the water contained in the water-soluble ink may make the recording sheet wavy or swell it during a printing operation, as a result of which it becomes rather difficult to convey the recording sheet to the following work position.

In order to eliminate the difficulty, Japanese Unexamined Published Patent Application No. 156536/1979 has disclosed a device in which hot air is blown against the recording sheet on the platen to dry the ink. Also, U.S. Pat. No. 4,340,893 has disclosed a device in which hot air is blown against the recording sheet directly through the carriage to dry the ink on the recording sheet as soon as data is recorded on it. However, those conventional devices are still disadvantageous in that, in general, characters or patterns recorded on a recording sheet often vary in density, and sometimes they may be solid black. Hence, even if a hot air dryer is set downstream of the recording section to dry the recording sheet, it is rather difficult to sufficiently dry parts of the recording sheet having a high pixel density. As a result, wet parts of the recording sheet may be brought into contact with the back side of the following recording sheet, thus spoiling the recorded image. Also, parts of the recording sheet swelled and buckled by the ink may be brought into contact with the printing head, thus wearing the latter.

SUMMARY OF THE INVENTION

Accordingly, a first object of this invention is to provide an ink jet printer in which, even when an image to be printed includes a part having a relatively high density requiring a relatively large quantity of ink, the recording medium is uniformly dried in its entirety.

In order to achieve the aforementioned first object of the invention, an ink jet printer is provided in which, according to the invention, the speed of conveyance of the recording medium is controlled according to the image density.

A second object of the invention is to provide an ink jet printer in which the distance between the recording medium and the recording head is maintained constant to eliminate the difficulty of a printed image being spoiled by contact of the head with the recording medium, whereby the resultant image is maintained high in accuracy.

In order to achieve the second object of the invention, in the ink jet printer a pair of sheet retaining means are provided before and behind in the direction of travel of recording means, and the one of the pair of sheet retaining means which is located before in the direction of travel is allowed to push the recording medium against the platen to form a gap between the recording medium and the printing head.

A third object of the invention is to provide an ink jet printer in which, according to the invention, the recording medium is conveyed with the recorded image unaffected.

For this purpose, cylindrical rollers relatively small in wall thickness and plate-shaped rollers with peripheral teeth are provided downstream of the recording means and mounted in such a manner that the rollers are confronted with each other.

BRIEF DESCRIPTION OF THE DRAWINGS

The accompanying drawings, which are incorporated in and constitute a part of this specification, illustrate preferred embodiment(s) of the invention and, together with the description, serve to explain the objects, advantages and principles of the invention.

In the drawings.

DESCRIPTION OF THE PREFERRED EMBODIMENTS

Preferred embodiments of the invention will now be described with reference to the accompanying drawings.

Figure 1:
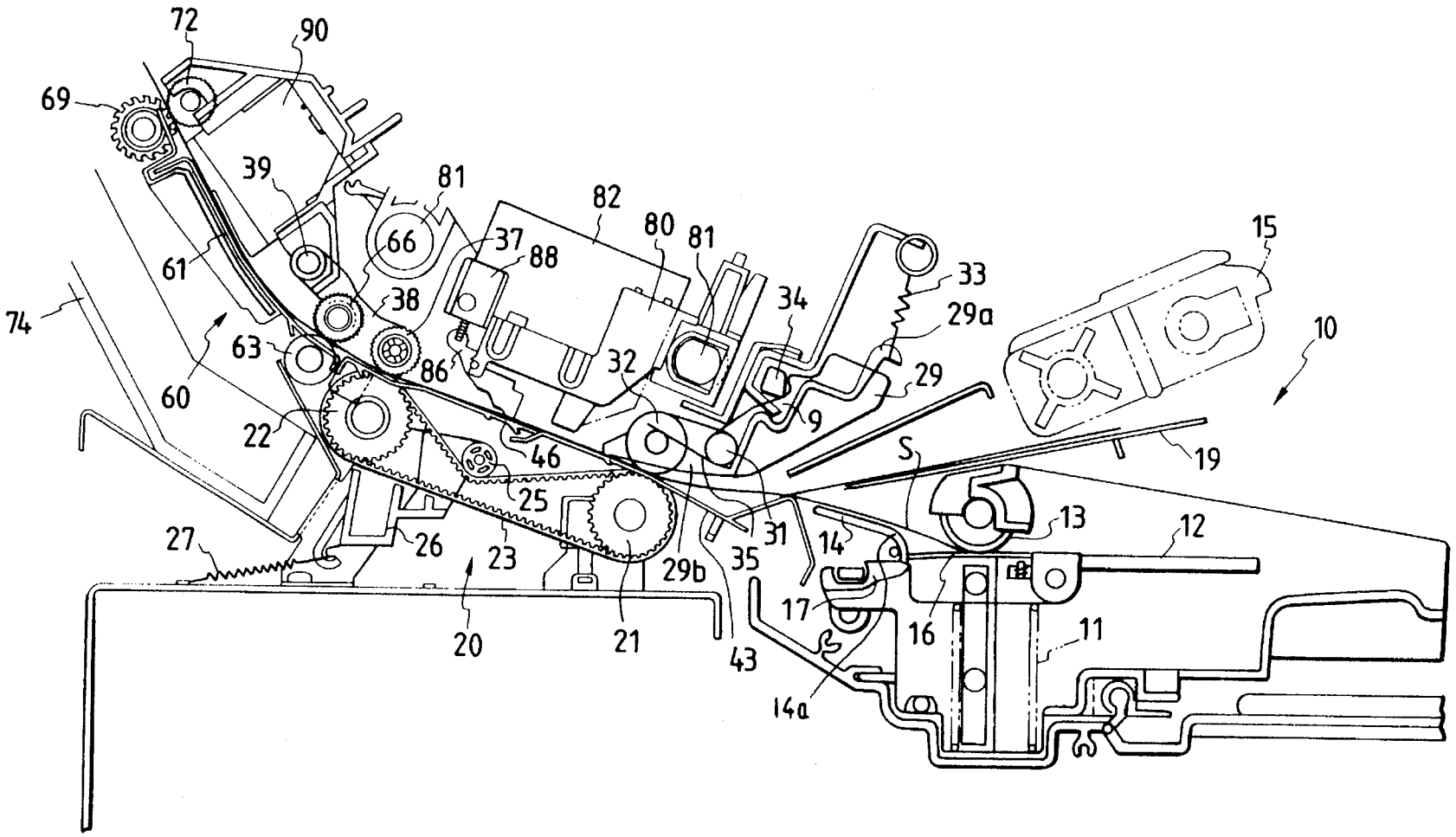
FIG. 1 is a side view of a typical example of an ink jet printer according to this invention.
Figure 2:
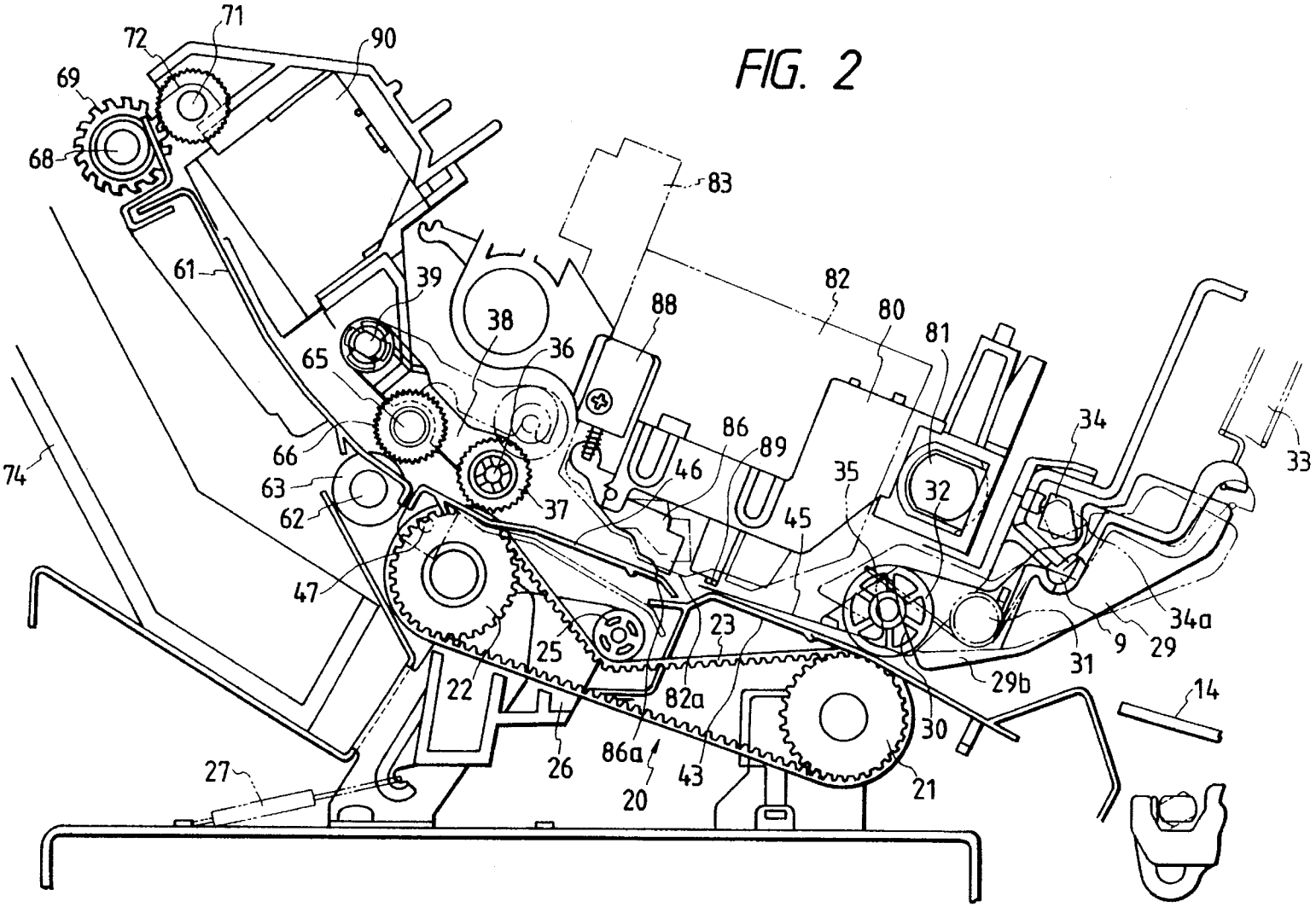
FIG. 2 is a side view showing essential components of the ink jet printer in detail.

FIG. 1 shows a typical example of an ink jet printer constructed according to the invention, and FIG. 2 shows essential components of the printer of FIG. 1 in detail.

The ink jet printer of FIG. 1 includes a recording medium means or mechanism extended between a sheet supplying section 10 and a sheet discharging section 60, a recording means in the form of a printing head 82 disposed along the sheet conveying path, and a recording medium drying means in the form of a hot air drying unit 90.

A sheet supplying stand 12 is disposed in the sheet supplying section 10. The sheet supplying stand is urged upwardly by a hopper spring 11 in such a manner that it is movable vertically, whereby the top of the recording medium in the form of a sheet S stacked on the sheet supplying stand 12 is held in abutment with a sheet supplying roller 13. A sheet conveying guide board 14 extends from the sheet supplying roller 13 to a gate roller 21. A separating pawl operating lever 17, which is operated up and down by a manual operating lever (not shown), and a separating pawl 16, which is operated by the lever 17, are arranged on the guide board 14. A web inserting guide board 19 is provided above the sheet supplying stand 12 confronting the sheet supplying opening 3 formed in the front board 2 of a printer body 1 (FIG. 10), so that the recording sheet on the web is directly fed into the gate roller 21 with the aid of a tractor 15.

The guide board 19 is followed by a sheet conveying section 20. In the sheet conveying section 20, the gate roller 21 engaged with a drive force transmitting mechanism (not shown) is arranged beside a carriage 80 on the upstream side of the travel path of the latter. The gate roller 21 is designed so that it performs an intermittent feed operation at a speed corresponding to the pixel density of a character or pattern recorded on the recording sheet S. A driven roller 22 is provided behind a platen 46, and a sheet conveying belt 23 is laid over the driven roller 22 and the gate roller 21. The gate roller 21 rotates the driven roller 22 through the sheet conveying belt 23 at the same peripheral speed. The sheet feed belt 23 contacts an idler 25 directly below the platen 46. The idler 25 is supported on one end portion of an idler lever 26. A tension spring 27 is connected to the idler lever 26 so as to apply a predetermined tension to the sheet conveying belt 23.

A sheet retaining roller lever 29 is supported above the gate roller 21 in such a manner that it is swingable about a fulcrum 31. The sheet retaining roller lever 29 is designed so as to change the contact pressure between the sheet conveying belt 23 and a sheet retaining roller 32 separately according to the kinds of recording media to be conveyed, i.e., according to whether the recording medium is conveyed by the frictional force produced between the sheet conveying belt 23 and the sheet conveying roller 32, as in the case of a recording sheet or envelop, or whether the recording medium is conveyed by the tractor 15, as in the case of a web. A strong retaining spring 33 is connected to one end of the upper arm 29*a* of the sheet retaining roller lever 29 to turn the lever 29 counterclockwise in FIG. 1, while a cam 34 is engaged with the upper arm 29*a* to turn the lever 29 clockwise in FIG. 1 against the elastic force of the spring 33.

When, as indicated by the solid lines, the cam 34 is released to cause the strong spring 33 to act directly on the lever 29, the sheet retaining roller 32, positioned in an arcuate groove 30 formed in the lower arm 29*b* of the lever 29, is strongly pushed against the sheet conveying belt 23. On the other hand, when, as indicated by the two-dot chain lines in FIG. 2, the cam 34 lowers the lever 29 to release the strong spring 33, the sheet retaining roller 32 is weakly pushed against the sheet conveying belt 23 by one end portion 35 of a weak coil spring 31, the other end of which is connected to the sheet retaining roller lever 29.

Figure 3:
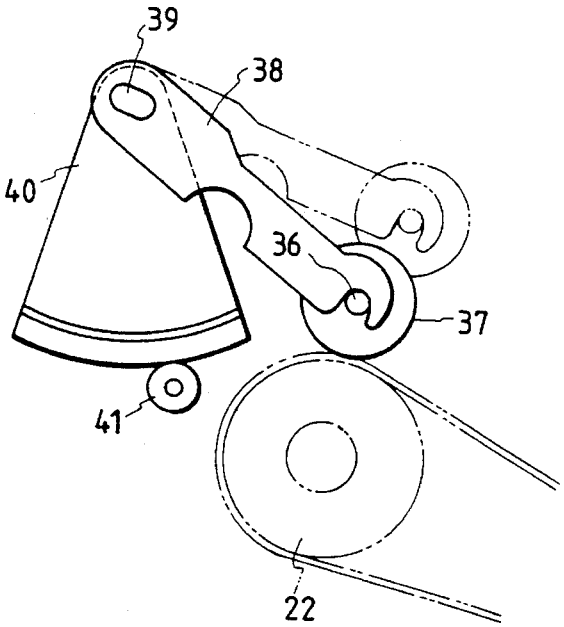
FIG. 3 is an explanatory diagram showing a paper bail mechanism in the printer of the invention.

A paper bail 37 provided above the driven roller 22 is moved into or out of engagement with the sheet conveying belt 23. The paper bail 37 is composed of a shaft 36 and a plurality of plate-shaped rollers with peripheral teeth, which are fixedly mounted on the shaft 36. The paper bail 37 is supported on one end portion of a paper bail lever 38, which is secured to a supporting shaft 39 provided downstream of the driven roller 22. As shown in FIG. 3, a sector gear 40 engaged with a pinion 41 is secured to the supporting shaft 39. The sector gear 40 is turned clockwise in FIG. 3, immediately before the recording sheet S passes through the gate roller 21, to push the paper bail 37 (supported by the end of the paper bail lever 38) against the sheet conveying belt 23 thereby to convey the recording sheet S.

A recording sheet carry-in side guide board 43 is provided upstream of the platen 46. The start edge of the guide board 43 is coterminous with the meeting point of the web inserting guide board 19 and the sheet conveying guide board 14 extended from the sheet supplying roller 13, and the end edge is located immediately before the printing section connected to the platen 46. At that position, a sheet retaining board 45 is held abutted against the guide board 43 by its own elasticity.

The platen 46 is disposed directly below the travel path of the carriage. The base end of the platen 46 is secured to a fulcrum shaft 47 provided downstream of the platen 46. The platen 46 is lowered, or retracted, to the position indicated by the two-dot chain line in FIG. 2 by a lever (not shown) coupled through a link to the manual operating lever adapted to operate the separating pawl operating lever 17, thereby to allow the passage of a recording medium such as an envelope relatively large in thickness.

Figure 4:
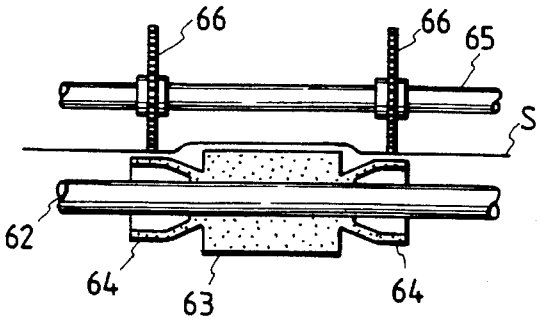
FIGS. 4, 5*a* and 5*b* are diagrams showing examples of intermediate sheet discharging rollers in the printer of the invention.

A pair of intermediate sheet discharging roller shafts 62 and 65 are arranged downstream of the driven roller 22 in such a manner that they are adjacent to the driven roller 22. The intermediate sheet discharging roller shaft 62 is located below the other intermediate sheet discharging roller shaft 65 and below a sheet discharging guide board 61. As shown in FIG. 4, a plurality of short intermediate sheet discharging rollers 63 made of an elastic material are fixedly mounted on the shaft 62 spaced from one another. Each of the rollers 63 has cylindrical rollers 64 and 64 having a small wall thickness at both ends. On the other hand, the upper intermediate sheet discharging roller shaft 65 on the side of the head 82 has a plurality of thin-plate-shaped toothed rollers 66. More specifically, the toothed rollers 66 are mounted on the roller shaft 65 in such a manner as to confront with the cylindrical rollers 64 of the intermediate sheet discharging rollers 63 so that they, together with the cylindrical rollers 64, gently nip the wet recording sheet S to discharge it.

Figure 5A:
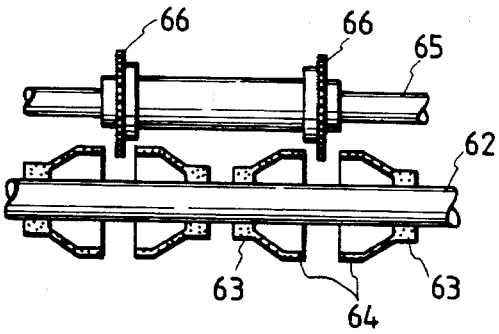
Figure 5B:
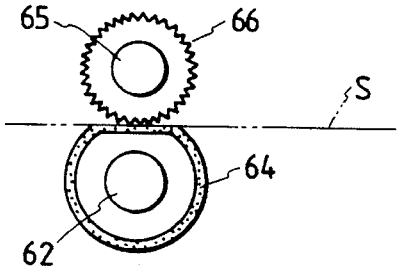

The intermediate sheet discharging rollers 63 and 66 may be designed as shown in FIG. 5*a*. A plurality of intermediate sheet discharging rollers 63 are mounted on the lower intermediate sheet discharging roller shaft 62 spaced from one other another, and the cylindrical rollers 64 of adjacent ones of the sheet discharging rollers 63 are confronted with each other. A plurality of thin-plate-shaped toothed rollers 66 are mounted on the upper roller shaft 65, which is located on the side of the head 82, in such a manner that each toothed roller 66 is located between the adjacent cylindrical rollers 64 and 64 extending slightly into the space between the cylindrical rollers 64 and 64. This eliminates the difficulty of, in the conveyance of the recording sheet, ink on the teeth of the toothed rollers 66 sticking to the intermediate sheet discharging rollers 63 and thus staining the back side of the recording sheet S.

Figure 6:
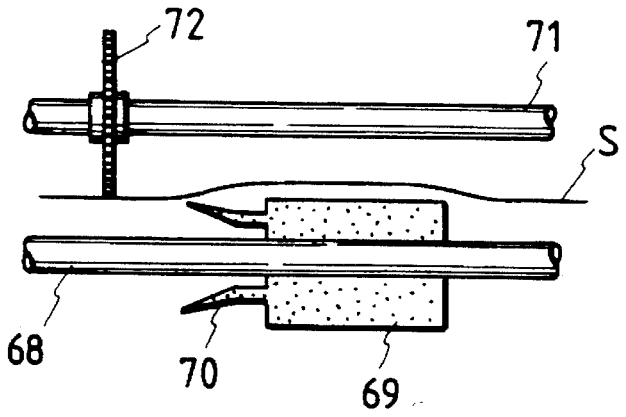
FIG. 6 is a diagram showing sheet discharging rollers in the printer of the invention.

A pair of sheet discharging roller shafts 68 and 71 are provided downstream of the hot air drying unit 90 (described later in detail). The upper shaft discharging roller shaft 68 is disposed below the sheet discharging board 61. A plurality of sheet discharging rollers 69 made of an elastic material are fixedly mounted on the upper sheet discharging roller shaft 68. Each of the sheet discharging rollers 69, as shown in FIG. 6, has a cylindrical roller 70 only at one end thereof. The upper sheet discharging roller shaft 71 on the side of the head 82 has a plurality of thin-plate-shaped toothed rollers 72. More specifically, the toothed rollers 72 are mounted on the roller shaft 71 in such a manner that they are spaced from the cylindrical rollers 70 and are slightly overlapped with the latter as viewed in the axial direction. These rollers 69 and 72 strongly wave the dried recording sheet S in the direction of conveyance so that the recording sheet S is delivered flat onto a sheet discharging tray 74 while being stiffened.

The carriage 80 is moved while being guided by two guide rails 81 and 81 which are laid perpendicular to the recording sheet conveyance direction. The carriage 80 is provided with the ink jet head 82, which jets ink through at least one nozzle onto the recording sheet S.

Figure 7:
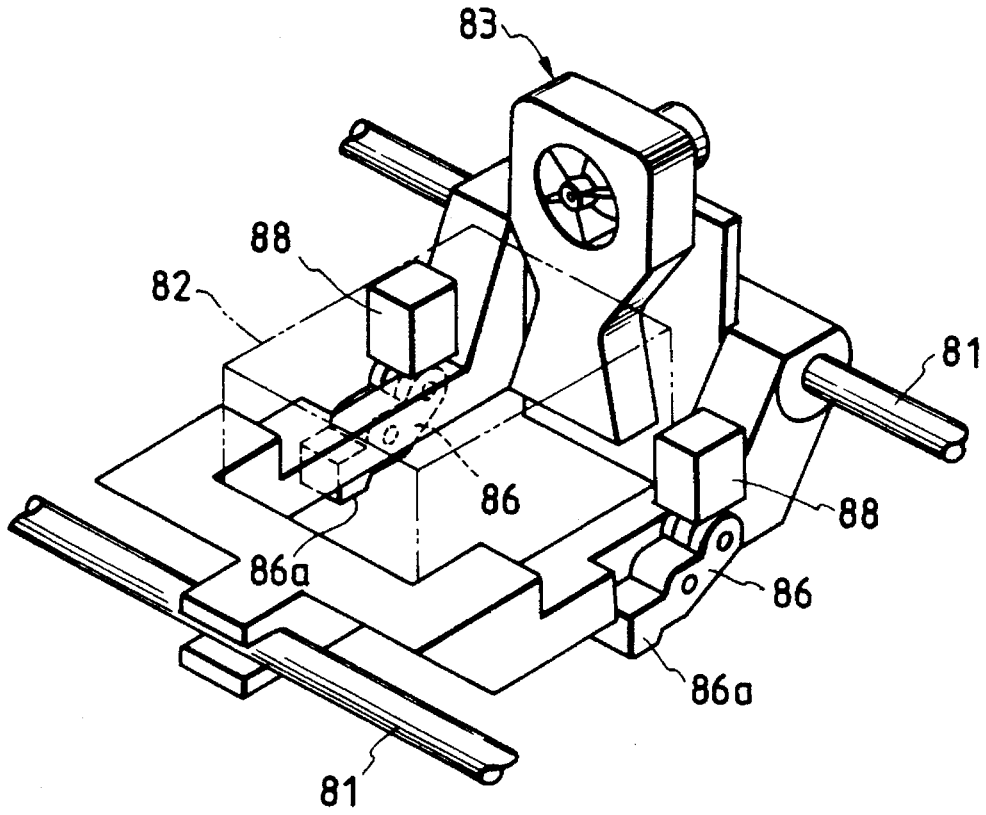
FIG. 7 is a perspective view showing a carriage in the printer of the invention.
Figure 8A:
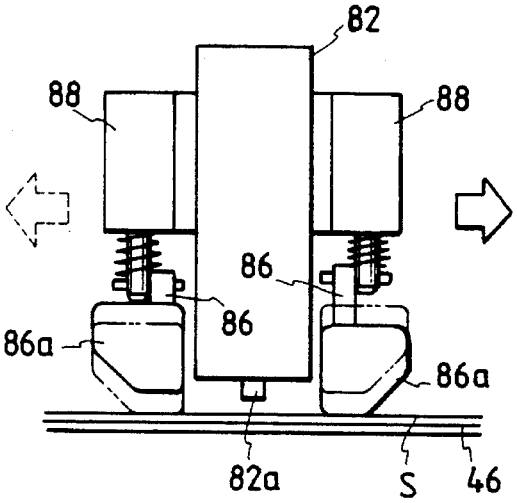
FIGS. 8*a* and 8*b* are diagram showing examples of sheet retaining levers and their operations.

As shown in FIGS. 7 and 8*a*, a sheet retaining means comprises a pair of solenoids 88 and 88 are provided on both sides of the carriage 80. Further a pair of sheet retaining levers 86 and 86, which are driven by respective ones of the solenoids 88 and 88, are swingably supported on both sides of the lower surface of the carriage 80 in such a manner that the end portion 82*a* of the head 82 is positioned between them. When the carriage 80 travels, the end portions 86*a* of the sheet retaining levers 86 are alternately moved up an down, as indicated in FIG. 8*a*, in such a manner that the end portion 86*a* located before the other lever 86 in the direction of travel is lowered while the end portion 86*a* of the other sheet retaining lever 86 is raised, whereby printing is carried out while the front part of the recording sheet S is being pushed against the platen 46 with the end portions 86*a* of the sheet retaining levers 86.

Figure 8B:
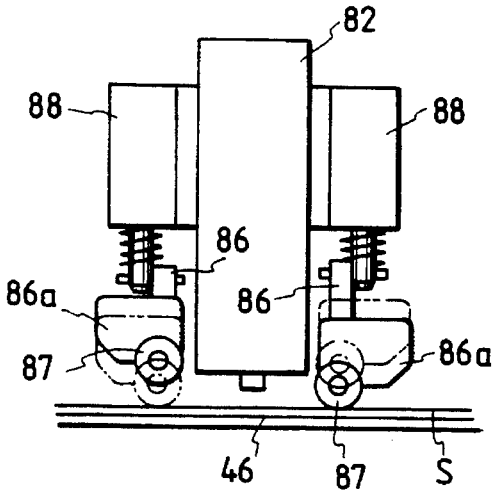

As shown in FIG. 8*b*, rollers 87 may be coupled to the end portions 86*a* of the sheet retaining levers 86 so that the end portions 86*a* of the sheet retaining levers 86 can push the recording sheet S against the platen 46 while smoothly moving on the recording sheet S.

Figure 9A:
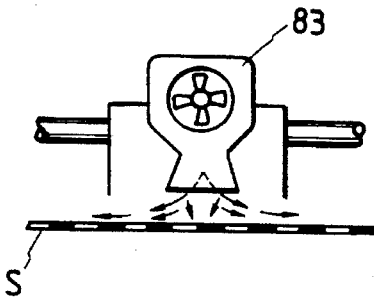
FIGS. 9*a* and 9*b* are diagrams for a description of the dust removing operation of a duct-integrated fan in the printer of the invention.
Figure 9B:
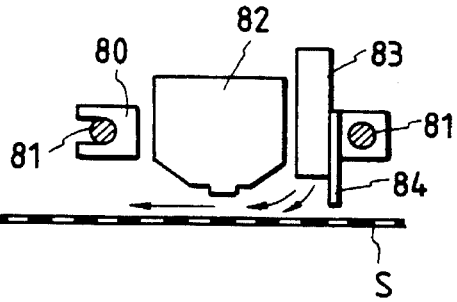

As shown in FIG. 7, air stream directing means comprises an integral-duct type fan 83 with an inverted-V-shaped air blowing outlet is provided downstream of the carriage 80 in the sheet conveyance direction. The fan 83 is designed so that, as shown in FIGS. 9*a* and 9*b*, air streams are applied to the recording sheet S while being deflected right and left by a baffle plate 84 set vertically on one side of the carriage 80, and then directed to the other side, thus blowing dust, paper powder or the like off the recording sheet.

As shown in FIG. 2, an upward movement regulating piece 89 is mounted upstream of and below the carriage 80 in such a manner that it forms a small gap with the end of a retaining board 45. When a relatively thick recording sheet S such as an envelope is delivered to the printing section, the regulating piece 89 prevents the retaining board 45 from being moved upwardly.

Figure 10:
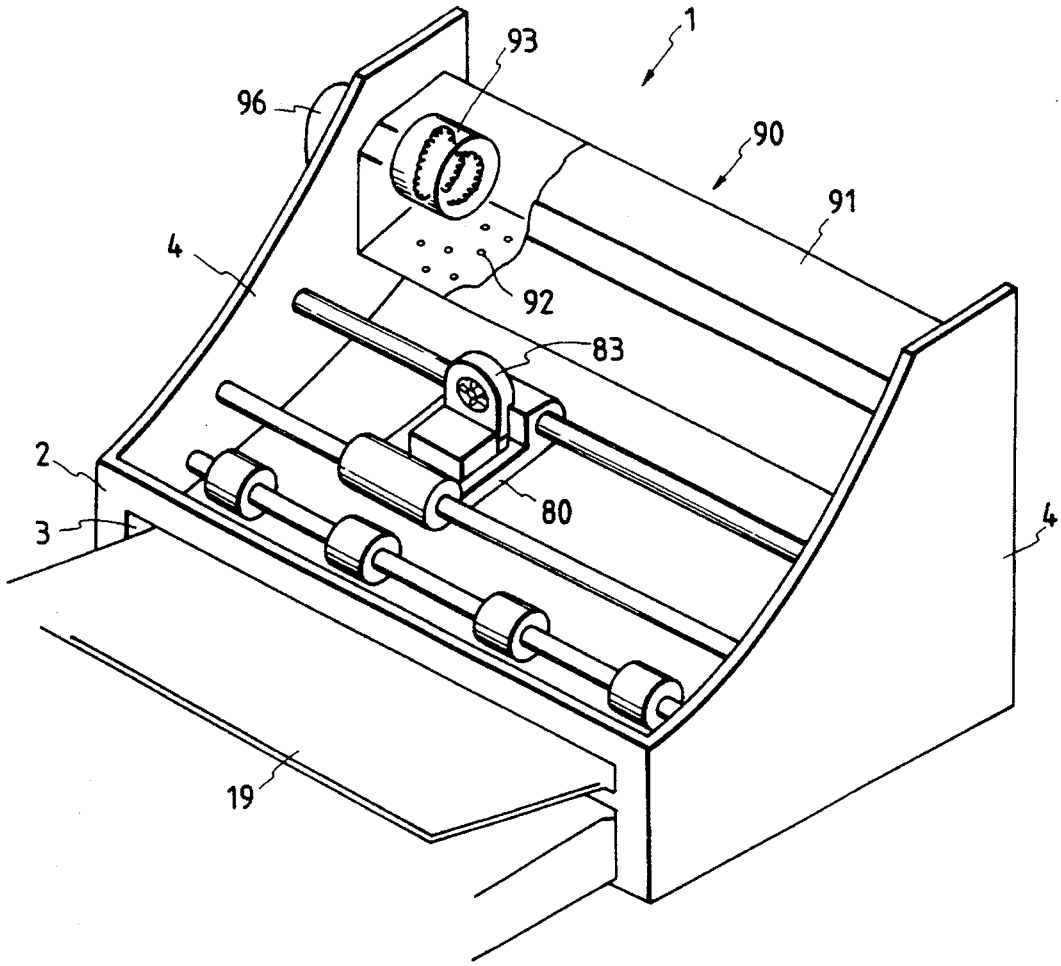
FIG. 10 is an external view of the printer of the invention, showing its hot air drying unit.

The hot air drying unit 90 operates to dry the recording sheet S, on which data have been recorded, by applying hot air to it. As shown in FIG. 10, the drying unit 90 is mounted on two side boards 4 and 4 of the printer body 1. The drying unit 90 includes a duct 91 confronting a sheet discharging guide board 61 (FIG. 2), a heater 93 accommodated in the duct 91, and a fan 94 (FIG. 11) installed at a suitable location in the printer body 1. Air which is introduced into the duct 91 through an air pipe 96 from the fan 94 is heated by the heater 93, and the air thus heated is directed against the recording sheet through a number of small air blowing holes 92 formed in the lower board of the duct 91 and directed in the sheet conveyance direction.

Figure 11:
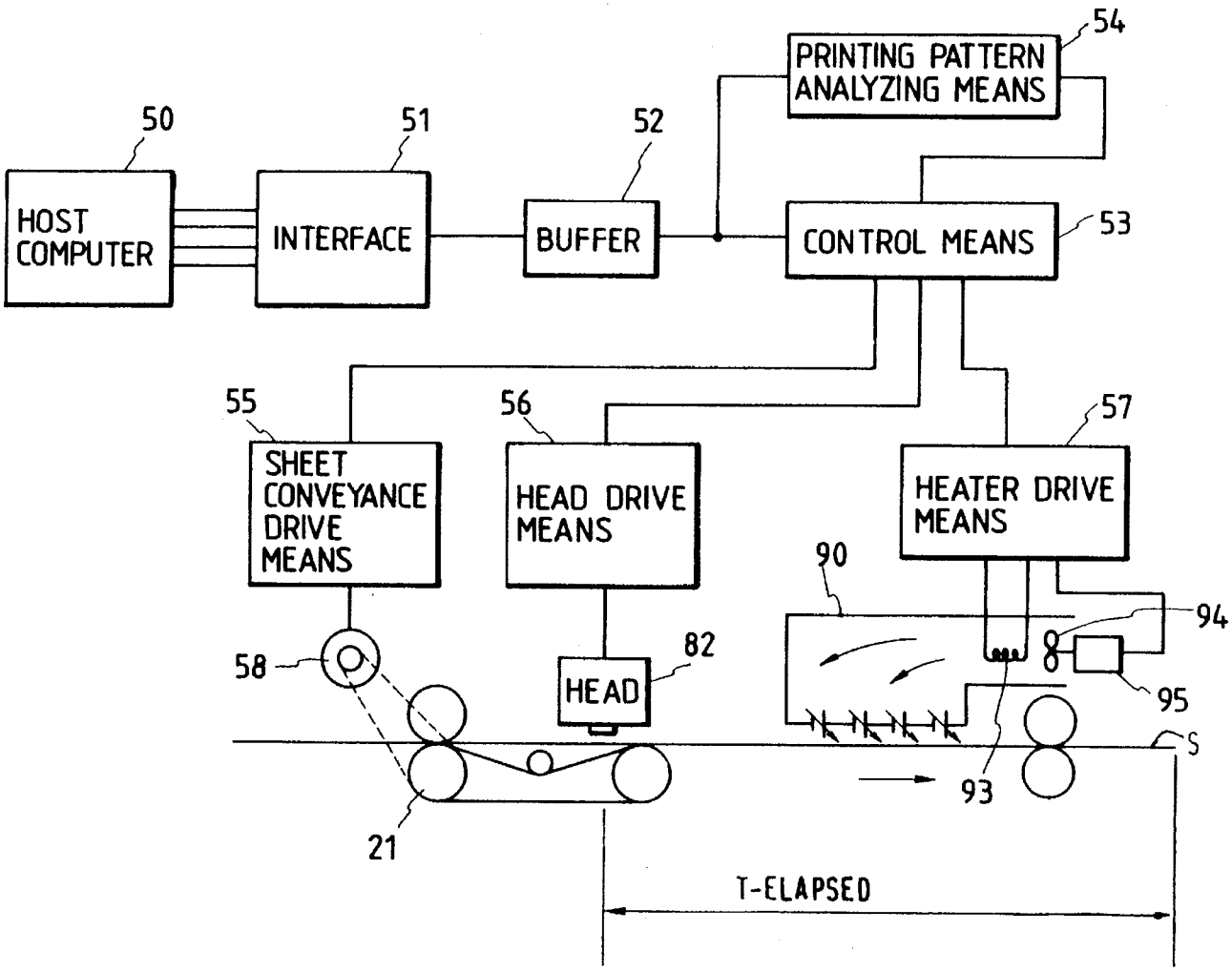
FIG. 11 is an explanatory diagram, partly as a block diagram, showing a control circuit in the printer of the invention.

A control circuit for the printer is arranged as shown in FIG. 11.

In FIG. 11, a host computer 50 provides recording data for one page, for instance, to be printed. The recording data are applied through an interface 51 to a buffer 52 so as to be stored in the latter 52. In accordance with an input signal provided by the buffer 52, and a preset program, a control means 53 applies control signals to a sheet conveyance drive means 55, a head drive means 56, and a heater drive means 57, so that a drive motor 58, the printing head 82, and a heater 93 and a fan motor 95 perform sheet conveyance, a recording operation, and a recording sheet drying operation, respectively.

Figures 12, 13, 14:
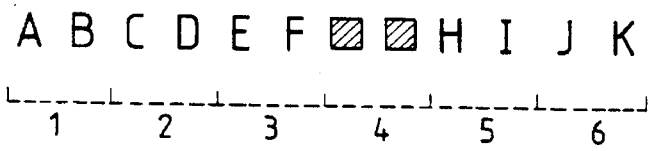
FIG. 12 is an explanatory diagram showing writing regions in a line.
FIG. 13 is a diagram showing a print drying table indicating quantities of ink per unit area with corresponding ink drying time periods.
FIG. 14 is a diagram showing a drying control table indicating ink drying completion time instants determined from ink drying time periods for a plurality of lines.

In the printer, the recording data stored in the buffer 52 are applied to a printing pattern analyzing means 54. The latter 54 determines from the input recording data the quantity of ink, or the number of dots, for printing each of several regions 1 through 6, as shown in FIG. 12, defined along a printing line. More specifically, a detecting means comprising the printing pattern analyzing circuit 54 detects the region having the largest number of dots in each line, i.e., the region having the largest pixel density in each line (in the case of FIG. 12, the fourth region, indicated by shading) and, for every line, applies the number of dots together largest pixel density region, as data, to the control means 53. A print drying table indicating relationships between quantities of ink per unitary area and corresponding ink drying time periods, as shown in FIG. 13, is stored in a ROM (not shown). Referring to the print drying table and the largest number of dots of the region i.e. pixel density thus inputted, the control means 53 determines an ink drying time period (Dx). In this manner, unusual ink drying time periods (Dx) for all lines i.e. each and every line are obtained. These ink drying time periods (Dx) are added successively to determine are estimated ink drying completion time instants (Tx) for all the lines previous to and including the present line (example as shown in FIG. 14; D2=2, D3=4, D4=6 . . ., T2=88, T3=92, T4=98 . . .; T4=T2+D3+D4). The ink drying time periods (Dx) and the estimated ink drying completion time instants (Tx), defined, as a drying control table (FIG. 14), are written in a RAM (not shown). Referring to the drying control table, the control means 53 calculates an estimated drying completion time instant Tx and compares the time instant thus calculated with the present time instant (T-elapsed). Based upon this time comparison, the control means 53 will control the drive motor 58 to intermittently convey the recording sheet S through the printer.

Next, the operation of the ink jet printer will be described.

In a sheet conveying mode, in which a recording sheet is being conveyed, in the sheet supply section 10, the separating pawl operating lever 17 is positioned as shown in FIG. 1 with a manual operating lever (not shown), so that the separating pawl 16 is abutted against the front end of the top one of the recording sheets S stacked on the sheet supplying stand 12. On the other hand, the lever (not shown) coupled to the manual operating lever lifts the platen 46 until the latter 46 becomes flush with the sheet conveyance guide board 43, and turns the cam 34 to the position indicated by the solid line in FIG. 2 to release the sheet retaining roller lever 29. As a result, the strong spring 33 acts on the sheet retaining roller lever 29 to strongly push the sheet retaining roller 32 coupled to the lever 29 against the sheet conveying belt 23.

When, under this condition, the sheet supplying roller 13 is rotated, the top one of the recording sheets S stacked on the sheet supplying stand 12 is separated from the remaining sheets with the separating pawl 16, and moved along the sheet conveyance guide board 14 and the sheet conveyance guide board 43 to the gate roller 21. Since the gate roller 21 is strongly pushed against the sheet retaining roller 32 through the sheet conveying belt 23, the recording sheet S is conveyed to the printing section.

When the recording sheet S is delivered to the printing section, the carriage 80 starts traveling along two guide rails 81 and 81, while the sheet retaining lever 86 located forwardly in the direction of travel of the carriage is turned by the solenoid 88 so that its end portion 86a pushes the recording sheet S against the platen 46. That is, the front end portion of the recording sheet S is pushed by the sheet retaining lever 86 to form a predetermined clearance between the recording sheet S and the printing head 82. Under this condition, characters, patterns, etc., are recorded on the recording sheet S according to the inputted recording data. At the same time, the integral-duct type fan 83 on the carriage 80 operates to blow air against the recording sheet S through the inverted-V-shaped air blowing outlet to form air streams which are directed from one side to the other while being deflected right and left, thus blowing dust, paper powder or the like off the recording sheet in order to prevent the sticking of such foreign matter to the nozzle.

On the other hand, at the beginning of the sheet conveyance, the paper bail lever 38 is turned upwardly by the pinion 41 engaged with the sector 40, so that the paper bail 37 coupled to the end of the paper bail lever 38 is spaced away from the sheet conveying belt 23. That is, the recording sheet S on which dot image has been recorded is moved under the paper bail 37. Hence, the recording sheet S is delivered to the sheet discharging section 60 without spoiling the dot image.

At the same time, the thin toothed rollers 66 arranged immediately after the driven roller 22 are rotated while in contact with the cylindrical rollers 64 of the intermediate sheet discharging rollers 63. Hence, the recording sheet S wetted through the data writing operation is delivered into the hot air drying unit 90 while being in contact with the teeth of the thin toothed rollers 66 in a dotted form and being gently held between the toothed rollers 66 and the cylindrical rollers 64 of the intermediate sheet discharging rollers 63. Therefore, in this operation, the dot image on the recording sheet S is not spoiled at all. In the hot air drying section 90, the recording sheet S is dried with hot air as required. The recording sheet S thus processed is delivered into the sheet discharging tray 74 by the sheet discharging rollers 69 and 72.

When, in the above-described operation, the rear edge of the recording sheet S arrives at a position immediately before the gate roller 21, a sheet edge detecting sensor (not shown) detects the rear edge to output a detection signal. In response to the detection signal, the pinion 41 is rotated to swing the paper bail lever 38 downwardly through the sector 40. As a result, the paper bail 37 at the end of the paper bail lever 38 is pushed against the sheet conveying belt 23, thus holding the recording sheet S. Thus, the recording sheet S released from the gate roller 21 is forwarded to the hot air drying unit 90 with the recorded image maintained unaffected.

In the case where, in the above-described dot image recording operation, pixels forming a pattern, etc., are extremely high in density, the parts of the recording sheet S to which a large quantity of ink has been applied is greatly wetted to the extent that the part is greatly made wavy or swelled. The printing pattern analyzing means 54, receives data to be recorded from the buffer 52, detects this phenomenon i.e. areas of extremely high pixel density, in advance, detects the region having which has the largest number of dots in every line, and applies this numerical data, indicative of the regions and the numbers of dots, to the control means 53. The control means 53, refers to the relationships between quantities of ink per unitary area and corresponding ink drying time periods (as shown in FIG. 13), stored in advance, to form a drying control table (as shown in FIG. 14). The control means 53 compares the present time instant-elapsed with the estimated ink drying completion time instant for each line Tx, and determines whether or not to convey the sheet S. When the control means 53 determines that the present time instant T-elapsed is after the estimated ink drying completion time instant, the drive motor 58 is operated and sheet S conveyed. If Tx<T-elapsed, the drive motor 58 is held in a standby state. That is, the drive motor 58 is operated intermittently at intervals corresponding to the printing densities of those high ink density regions in the printed lines.

In the case where the printing operation is carried out for stacked envelopes or the like, the separating pawl operating lever 17 is operated with the manual operating lever to disengage the separating pawl 16 from the envelopes, and the platen 46 is retracted to the position indicated by the two-dot chain line in FIG. 2 with a lever which is operated in association with the manual operating lever. As a result, the envelope taken out of the stack with the sheet supplying roller 13 is delivered to the gate roller 21 while being guided by the slope 14a provided before the sheet conveying board 14, and then conveyed into the printing section while being strongly nipped by the sheet retaining roller 32 and the sheet conveying belt 23. Thus, the envelope is placed on the retracted platen, whereupon the sealing flap of the envelope is smoothly passed through the clearance over the platen 46, so that, similarly as in the case of the recording sheet, necessary data are recorded thereon.

In conveyance of a web with the tractor 15, the cam 34 is turned to the position indicated by the two-dot chain line in FIG. 2, and the sheet retaining roller lever 29 is turned clockwise in FIG. 2. As a result, the strong spring 33 acting on the lever 29 is released. Hence, the sheet retaining roller 32 together with the sheet conveying belt 23 supports the web with the aid of the weak spring 35, thus smoothly conveying the web into the printing section.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The above embodiment has been described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet printer comprising: recording means for jetting ink droplets while moving in a direction perpendicular to the direction of conveyance of a recording medium having a dot image forming side and a back side, to thereby form a dot image on said recording medium according to an input time, further comprising a cylindrical roller having a small wall thickness and which contacts the back side of said recording medium, and a plate-shaped roller with peripheral teeth and which contacts the dot image forming side of said recording medium, said cylindrical roller and said plate-shaped roller being provided downstream of said recording means in such a manner that said rollers are confronted with each other.

2. The ink jet printer as claimed in claim 1, wherein said plate-shaped roller and said cylindrical roller comprise nip rollers which gently nip said recording medium to discharge said recording medium having the dot image formed thereon.

3. The ink jet printer as claimed in claim 1, wherein said cylindrical roller having a small wall thickness is formed at at least one end of a solid discharging roller, said cylindrical roller and said solid discharging roller being formed of an elastic material.

4. The ink jet printer as claimed in claim 1, further comprising a first rotatable shaft for supporting said plate-shaped roller; and a second rotatable shaft for supporting said cylindrical roller.

5. The ink jet printer as claimed in claim 4, further comprising a plurality of cylindrical rollers mounted on said second rotatable shaft and spaced apart from one another; and a plurality of plate-shaped rollers mounted on said first rotatable shaft and spaced apart from one another.

* * * * *